US007446743B2

(12) United States Patent
Kwasnick

(10) Patent No.: US 7,446,743 B2
(45) Date of Patent: Nov. 4, 2008

(54) COMPENSATING ORGANIC LIGHT EMITTING DEVICE DISPLAYS FOR TEMPERATURE EFFECTS

(75) Inventor: Robert F. Kwasnick, Palo Alto, CA (US)

(73) Assignee: Intel Corporation, Santa Clara, CA (US)

( * ) Notice: Subject to any disclaimer, the term of this patent is extended or adjusted under 35 U.S.C. 154(b) by 605 days.

(21) Appl. No.: 09/951,834

(22) Filed: Sep. 11, 2001

(65) Prior Publication Data

US 2003/0048243 A1 Mar. 13, 2003

(51) Int. Cl.
*G09G 3/30* (2006.01)

(52) U.S. Cl. ..... 345/77; 345/76; 345/82

(58) Field of Classification Search ..... 345/74–78, 345/82–84, 60, 80, 204–206, 291; 315/291, 315/201, 504, 506, 169.3, 261; 313/501, 313/504, 506, 201

See application file for complete search history.

(56) References Cited

U.S. PATENT DOCUMENTS 5,594,463 A * 1/1997 Sakamoto ..... 345/76
5,904,961 A * 5/1999 Tang et al. ..... 427/561
5,910,792 A * 6/1999 Hansen et al. ..... 345/74.1
6,133,581 A * 10/2000 Terao et al. ..... 257/40
6,229,506 B1 * 5/2001 Dawson et al. ..... 345/82
6,229,508 B1 * 5/2001 Kane ..... 345/82
6,265,820 B1 * 7/2001 Ghosh et al. ..... 313/483
6,296,894 B1 * 10/2001 Tanabe et al. ..... 427/8
6,345,238 B1 * 2/2002 Goodwin ..... 702/130
6,366,017 B1 * 4/2002 Antoniadis et al. ..... 313/506
6,424,326 B2 * 7/2002 Yamazaki et al. ..... 345/77
6,456,016 B1 * 9/2002 Sundahl et al. ..... 315/291
6,473,065 B1 * 10/2002 Fan ..... 345/82
6,504,565 B1 * 1/2003 Narita et al. ..... 347/237
6,513,451 B2 * 2/2003 Van Slyke et al. ..... 118/719
6,607,277 B2 * 8/2003 Yokoyama et al. ..... 353/52
6,608,614 B1 * 8/2003 Johnson ..... 345/102
6,747,617 B1 * 6/2004 Kawashima ..... 345/76
6,805,448 B2 * 10/2004 Yokoyama et al. ..... 353/85
6,995,519 B2 * 2/2006 Arnold et al. ..... 315/169.3
7,262,753 B2 * 8/2007 Tanghe et al. ..... 345/82
2002/0117962 A1 * 8/2002 Beierlein et al. ..... 313/504
2003/0001488 A1 * 1/2003 Sundahl ..... 313/483
2004/0070558 A1 * 4/2004 Cok et al. ..... 345/76

* cited by examiner

*Primary Examiner*—Richard Hjerpe
*Assistant Examiner*—Mansour M Said
(74) *Attorney, Agent, or Firm*—Trop, Pruner & Hu, P.C.

(57) ABSTRACT

A display may be driven to compensate for the effects of aging on the display. In particular, the temperature of the display may be determined on an ongoing basis and utilized to further correct total integrated charge for temperature effects.

15 Claims, 3 Drawing Sheets

COMPENSATING ORGANIC LIGHT EMITTING DEVICE DISPLAYS FOR TEMPERATURE EFFECTS

BACKGROUND

This invention relates generally to organic light emitting device (OLED) displays that have light emitting layers.

OLED displays use layers of light emitting polymers or short molecule materials. Unlike liquid crystal devices, the OLED displays actually emit light making them advantageous for many applications.

Some OLED displays use at least one semiconductive conjugated polymer sandwiched between a pair of contact layers. Other OLED displays use small molecules. The contact layers produce an electric field that injects charge carriers into the light emitting layer. When the charge carriers combine in the light emitting layer, the charge carriers decay and emit radiation in the visible range.

It is believed that polymer compounds containing vinyl groups tend to degrade over time and use due to oxidation of the vinyl groups, particularly in the presence of free electrons. Since driving the display with a current provides the free electrons in abundance, the lifetime of the display is a function of total output light. Newer compounds based on fluorine have similar degradation mechanisms that may be related to chemical purity, although the exact mechanism is not yet well known in the industry. In general, OLED displays have a lifetime limit related to the total output light. This lifetime is a function of the display usage model.

The OLED display can be driven so as to increase its useful lifetime because as the display degrades, its output light is decreased. One way to drive the display to increase lifetime is to drive the display to increase the display's brightness. However, degradation may introduce output non-uniformity errors. If some of the pixels of the display are degraded non-uniformly, simply increasing the drive current of the display does not solve the non-uniform degradation problem. Even after increasing the drive current, some pixels will be brighter than other pixels.

Thus, there is a continuing need for ways of controlling OLED displays that compensate for display aging.

DETAILED DESCRIPTION

In one embodiment of the present invention, an organic light emitting device (OLED) display may include a pixel formed of three distinct color emitting layers. In this way, colors may be produced by operating more than one stacked subpixel layer to provide a "mixed" color. Alternatively, different subpixel color elements may be spaced from one another to generate three color planes.

Figure 1:
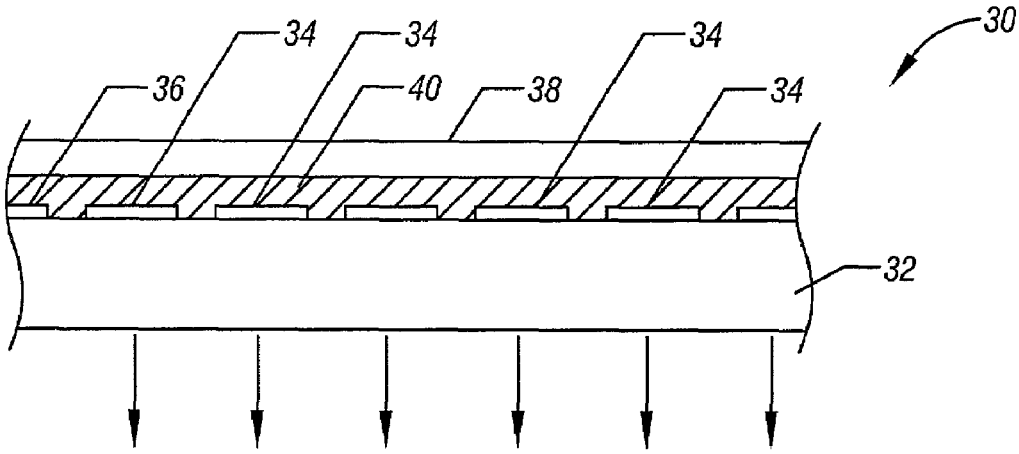
FIG. 1 is an enlarged, partial cross-sectional view in accordance with one embodiment of the present invention.

Referring to FIG. 1, an OLED display 30 may include a substrate 32, which in one embodiment may be formed of a glass layer. Light generated by the organic light emitting device 34 exits through the substrate 32 as indicated by the arrows.

In one embodiment, the organic light emitting device 34 is deposited on the substrate 32 and then covered with a thermal material 40. In some embodiments, the thermal material 40 may be a thermal epoxy or resin. Advantageously, the material 40 distributes heat generated by the light emitting device 34 for reasons described hereinafter. Alternatively, the layer 40 may include a combination of a passivation material that is moisture impervious that in turn is covered by thermal epoxy. One or more sensors 36 may be distributed along the length of the display 30. In one embodiment, the sensors 36 may also be deposited on the substrate 32. The sensors 36 may be thermistors or thermocouples as two examples.

Because of the thermal conductivity of the thermal material 40, the sensors 36 may accurately sense the heat generated by the organic light emitting device 34 when appropriate current drive is applied. Row and column electrodes (not shown) may be utilized to apply a suitable drive current to the organic light emitting device 34.

The thermal material 40 may be covered by a cover 38. In one embodiment, the cover 38 may comprise a dessicant, such as calcium oxide (CaO). As a result of the configuration shown in FIG. 1, an ongoing reading of the actual temperature of the organic light emitting material 34 forming the pixels of a display 30 is available.

The lifetime of the organic light emitting display 30 is a function not only of the total integrated charge Q but is also a function of the total effective integrated charge $Q_{eff}$. The total effective integrated charge may be calculated by including the impact of temperature on the integrated charge during a short time interval dt. In one embodiment, the temperature may be calculated at regular time intervals, dt, that are short relative to the variation in temperature of the display 30. For example, the temperature may be measured using the sensors 36 at intervals on the order of 1 to 100 seconds.

The correction for the integrated charge ($dQ_{eff}$) for the time interval dt may then be calculated by an experimentally determined functional form specific to the particular manufacturing process utilized. For example, the charge correction $dQ_{eff}$ may equal $A*dQ*\exp(-Ea/kT)$, where A and Ea are constants that are characteristic of the manufacturing process, dQ is the actual measured integrated charge during the time interval by circuitry external to the organic light emitting material 34, k is Boltzmann's constant, and T is the absolute temperature in degrees Kelvin. See I. D. Parker et al., J. of Applied Physics, Vol. 85, No. 4, 15Feb. 1999, pp. 2441-2447.

The contribution of $dQ_{eff}$ is then added to the previous $dQ_{eff}$ contribution to determine $Q_{eff}$. Finally, the previously characterized luminance versus current curve associated with that value of $Q_{eff}$ is applicable to compensation.

Further, the luminance versus current characteristics for the organic light emitting material 34 is temperature dependent. Generally, luminance increases 1% for each 3 degrees Centigrade increase in temperature near zero integrated charge (and sometimes much greater during aging). For a given manufacturing process, the luminance versus current curve for the organic light emitting device 34 is characterized as a function of total integrated charge and temperature. Therefore, the luminance versus current curve is used to determine the current needed to achieve a specified luminance as a function not only of the effective integrated charge, but also temperature.

Thus, by the incorporation of one or more sensors 36, as described above, an ongoing reading of temperature may be utilized. The effect of temperature on luminance can be determined so that the operation of the display 30 may be compensated for the effects, not only of total integrated charge, but also of temperature.

In some embodiments, the sensors 36 may be placed in direct contact with the device 34. However, in other embodiments, it is sufficient to use a plurality of sensors 36 not in direct contact with an array of light emitting devices 34. A sensor 36 may be electrically contacted through the substrate 32 in one embodiment. Alternatively, metalizations or other conductive depositions may be utilized to electrically couple the sensor 36. In still other embodiments, the sensor 36 may be contacted through the thermal material 40 or, if necessary, through the cover 38.

Figure 2:
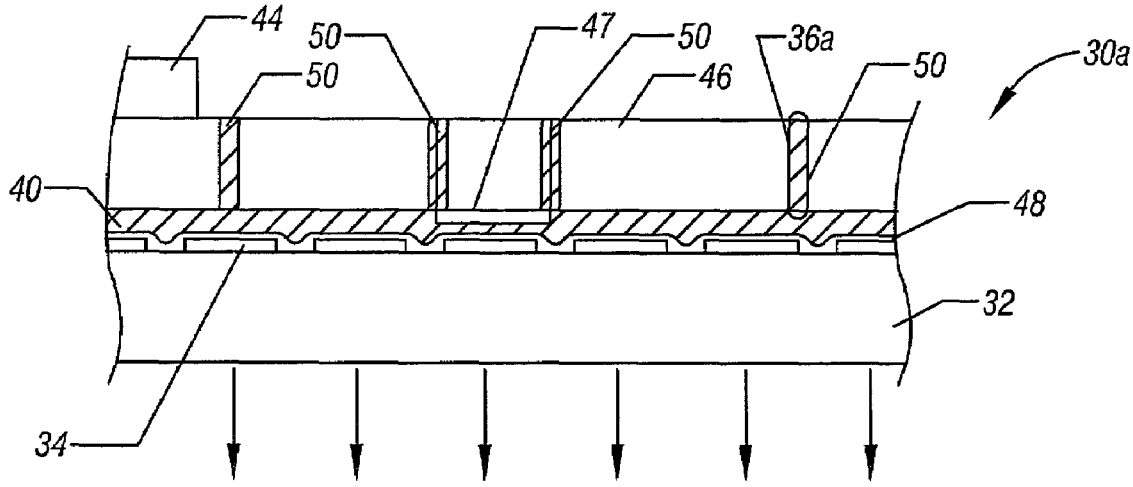
FIG. 2 is an enlarged, partial cross-sectional view of another embodiment of the present invention.

Referring to FIG. 2, a tiled display 30*a* may include a plurality of tiles, only one of which is shown in FIG. 2. In the tiled display 30*a*, each of the tiles making up the overall display 30*a* displays a portion of an overall image. The tiled display 30*a* displays a composite image made up of the contributions of each of the individual tiles.

Due to the need to substantially seamlessly abut the individual tiles one against the other, there may be no perimeter in which a temperature sensor may be placed. In such case, a back panel 46 may be used to create a closed space in which to receive the organic light emitting device 34. The device 34 may be formed on contacts (not shown) on the substrate 32, which may be a transparent glass layer in one embodiment. The organic light emitting device 34 depositions that form each subpixel may be covered by a passivation layer 48. The passivation layer 48 may be a moisture impervious material. The passivation layer 48 may be covered by a thermal material 40, such as epoxy or resin, as two examples.

In one embodiment, the back panel 46 may be a ceramic layer that provides for electrical connections to the individual subpixels formed of the device 34. For example, a driver circuit 44 may be electrically coupled to the individual device 34 depositions via the back panel 46.

In one embodiment, a temperature sensor 36*a* may be inserted in a fill hole 50. The fill hole 50 may be provided to inject the thermal material 40 in one embodiment. The thermal material 40 transfers the heat from the device 34 depositions to the sensors 36, which then may be coupled electrically to the integrated circuit 44 in one embodiment.

In one embodiment, a temperature sensor 47 on the inner surface of back panel 46 may be electrically coupled through vias or fill holes 50.

As an alternative embodiment, the sensor 36*a* may be formed on the back panel 46 itself on the surface of the back panel nearest a substrate 32.

In some embodiments, the sensor 36*a* may extend downwardly into closer contact or proximity to the material 34 depositions.

In some embodiments, electrical connections may be made between the back panel 46 and the OLEDs 34 on the substrate 32. For example, a surface mount technique, not illustrated in FIG. 2, may be utilized, wherein solder balls are utilized to electrically couple the driver circuit 44 through fill holes 50 in the back panel 46 to the devices 34. Again, row and column electrodes may be utilized to contact the device 34. Those row and column electrodes are not shown. They too may be formed on opposed front and back surfaces of the device 34 and one of the electrodes may be light transmissive.

With very large displays made up of a large number of display modules a plurality of sensors 36 may be employed to insure sufficiently accurate temperature measurements across the array. For example, there may be one sensor 36 in each display module. Advantageously, sufficient sensors 36*a* are utilized to insure that temperature changes of about 2° Centigrade are measured in one embodiment.

Figure 3:
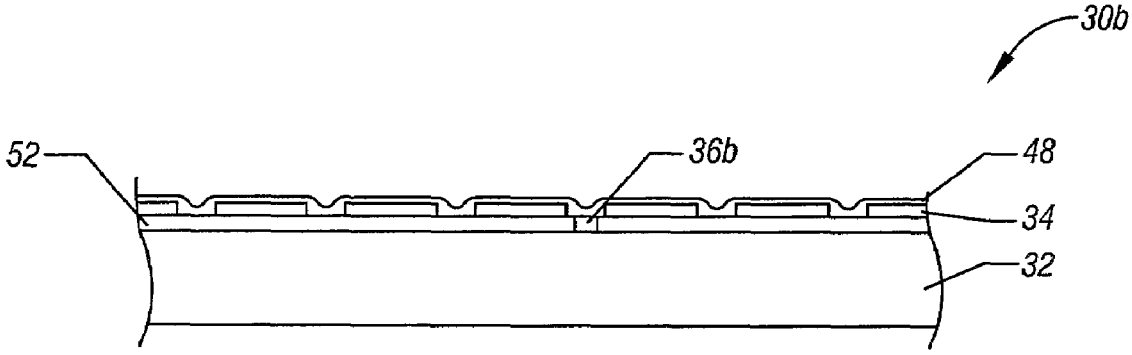
FIG. 3 is an enlarged, partial cross-sectional view in accordance with still another embodiment of the present invention.

Referring to FIG. 3, in a display 30*b*, the organic light emitting devices 34 emit light upwardly and not through the substrate 32 in one embodiment of the invention. Drive circuitry (not shown) may then be formed in the layer 52 on the substrate 32. A passivation layer 48 may be provided over the light emitting device 34. In such case, a sensor 36*b* may be incorporated or integrated with the other electronics in the layer 52. In one embodiment, the substrate 32 is silicon and the layer 52 and sensor 36*b* are circuitry formed at the top surface of the substrate 32 by integrated circuit processing techniques.

In another embodiment, the display temperature may be based on previously characterized current-voltage characteristics of the individual subpixels as a function of temperature and integrated charge. This method may be less accurate because of statistical variation in the predicted aging behavior of the display relative to the generally more stable behavior of temperature sensors. However, it does have the advantage of being a direct measurement of temperature and takes into consideration variations at all locations and may avoid the need for temperature sensors.

Figure 4:
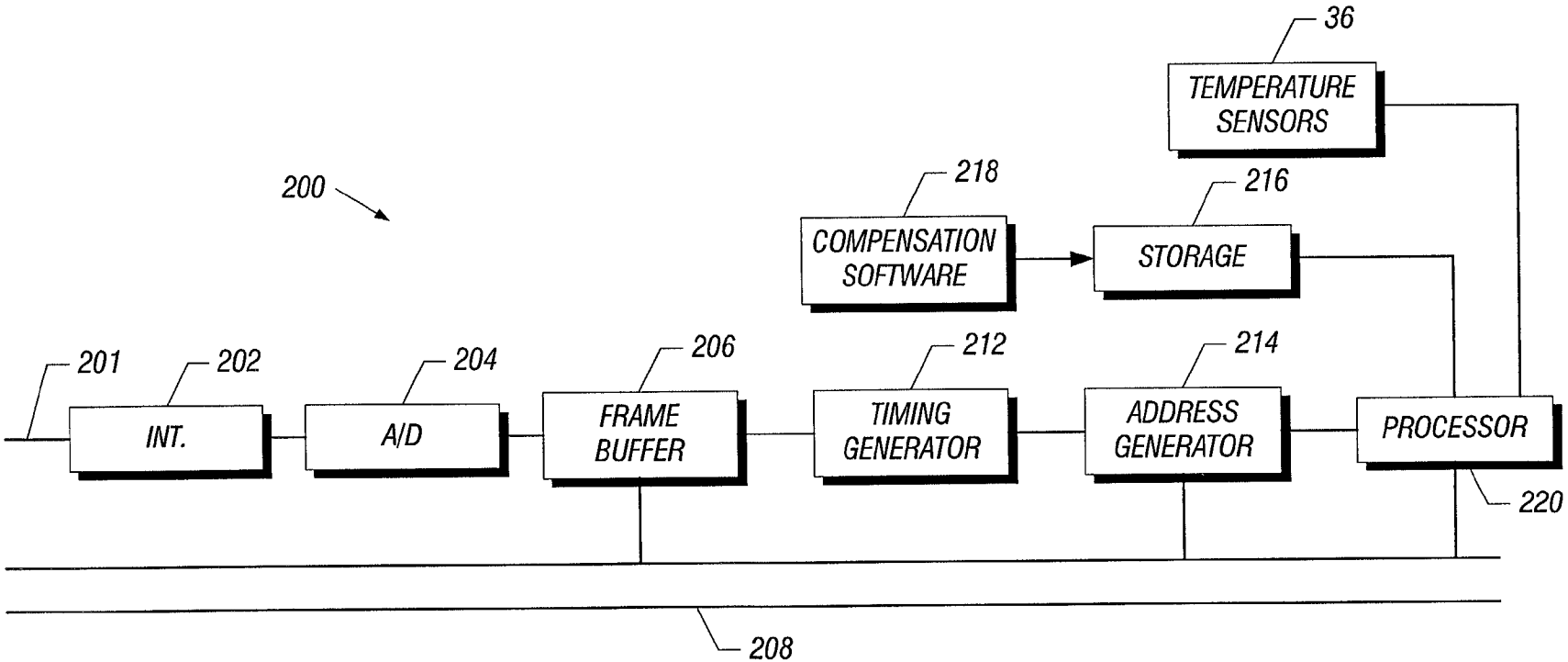
FIG. 4 is a block diagram of a system for implementing one embodiment of the present invention.

Referring to FIG. 4, the display may include an electrical system 200 that may be part of a computer system, for example, or part of a stand-alone system. In particular, the electrical system 200 may include a Video Electronic Standard Association (VESA) interface 202 to receive analog signals from a VESA cable 201. The VESA standard is further described in the Computer Display Timing Specification, V.1, Rev. 0.8 (1995). These analog signals indicate images to be formed on the display and may be generated by a graphics card of a computer, for example. The analog signals are converted into digital signals by an analog-to-digital (A/D) converter 204, and the digital signals may be stored in a frame buffer 206. A timing generator 212 and address generator 214 may be coupled to the frame buffer 206 to regulate a frame rate by which images are formed on the screen. A processor 220 may be coupled to the frame buffer 206 via a bus 208.

The processor 220 may be coupled to a storage device 216. In one embodiment of the present invention, compensation software 218 may be stored on the storage 216. The temperature sensors 36 may also be coupled to the processor 220.

Figure 5:
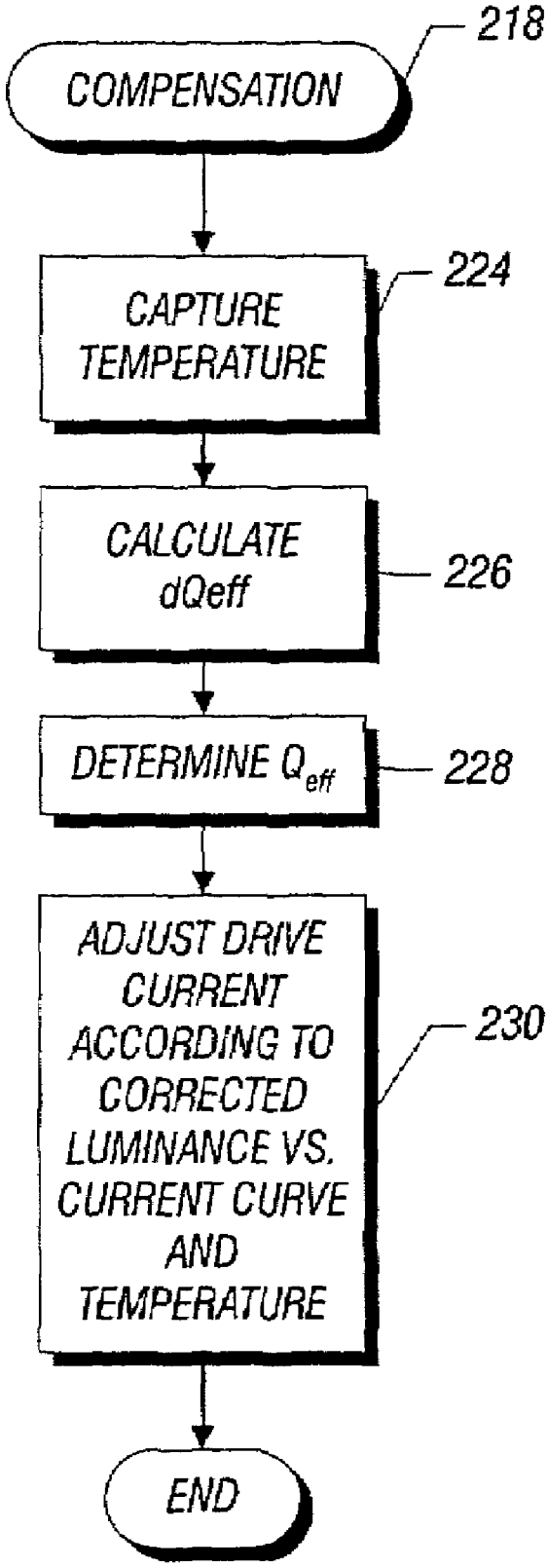
FIG. 5 is a flow chart for software in accordance with one embodiment of the present invention.

Referring finally to FIG. 5, the compensation software 218 may initially capture the temperature information from the sensors 36 at periodic intervals dt, as indicated in block 224. A correction for the total effective integrated charge may then be calculated as indicated in block 226. From this information the effective integrated charge $Q_{eff}$ may be calculated as indicated in block 228. The drive current to the display may then be adjusted according to the correct luminance vs. current curve as indicated in block 230 and the display temperature. Thus, in some embodiments, the temperature effects on luminance may also be compensated on an on-going basis.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An organic light emitting device display comprising:

a plurality of organic light emitting elements;

a temperature sensor formed within said display;

a controller to periodically and automatically determine the differential total effective charge for said organic light emitting elements; and a cover and a substrate with organic light emitting elements formed thereon, said cover enclosing said organic light emitting elements, and said temperature sensor positioned between said cover and said substrate, wherein said cover includes a fill hole to receive a filler material, said sensor being positioned within said fill hole.

2. The display of claim 1 wherein said sensor is formed on said substrate.

3. The display of claim 1 including a substrate, said light emitting elements formed on said substrate, said substrate including an integrated circuit layer, said sensor formed in said integrated circuit layer.

4. The display of claim 1 wherein said controller automatically calculates the drive current to compensate said display for the effects of the temperature of said elements.

5. The display of claim 1 wherein said controller uses the luminance versus current curve for the display to determine the appropriate drive current in view of the current temperature of said elements.

6. A method comprising:

forming an organic light emitting element on a substrate;

covering said organic light emitting element with a thermally conductive material;

covering said thermally conductive material with a cover;

providing an opening in said cover to receive a temperature sensor;

measuring a characteristic of the display indicative of temperature; and adjusting the output light intensity of said display in view of the measured temperature.

7. The method of claim 6 wherein measuring a characteristic of the display includes covering a plurality of organic light emitting elements with a thermally conductive material.

8. The method of claim 7 including placing a temperature sensor in thermal communication with said material.

9. The method of claim 8 including depositing an organic light emitting element on a substrate and forming the temperature sensor on said substrate in thermal contact with said organic light emitting element.

10. The method of claim 6 wherein providing an opening in said cover to receive a temperature sensor includes providing a hole in said cover to receive a temperature sensor and inserting the temperature sensor through said hole to sense the temperature under said cover.

11. The method of claim 10 wherein providing an opening in said cover to receive a temperature sensor includes using a fill hole that provides filler material to the region between said cover and substrate to receive said temperature sensor.

12. The method of claim 6 including forming an integrated circuit layer on a substrate, forming organic light emitting elements on said integrated circuit layer and forming a temperature sensor in said integrated circuit layer.

13. The method of claim 6 including automatically periodically measuring the temperature of said display.

14. A method comprising:

forming an organic light emitting element on a substrate;

covering said organic light emitting element with a thermally conductive material;

covering said thermally conductive material with a cover;

providing an opening in said cover to receive a temperature sensor; and providing a hole in said cover to receive a temperature sensor and inserting the temperature sensor through said hole to sense the temperature under said cover.

15. The method of claim 14 wherein providing an opening in said cover to receive a temperature sensor includes using a fill hole that provides filler material to the region between said cover and substrate to receive said temperature sensor.

* * * * *